US009120336B2

(12) United States Patent
Sawai

(10) Patent No.: US 9,120,336 B2
(45) Date of Patent: Sep. 1, 2015

(54) INK JET PRINTING APPARATUS AND CONTROL METHOD THEREOF

(75) Inventor: Yuki Sawai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 370 days.

(21) Appl. No.: 13/564,041

(22) Filed: Aug. 1, 2012

(65) Prior Publication Data

US 2013/0044152 A1 Feb. 21, 2013

(30) Foreign Application Priority Data

Aug. 19, 2011 (JP) ..... 2011-179777

(51) Int. Cl.

| | |
|---|---|
| ***B41J 13/00*** | (2006.01) |
| ***B41J 2/165*** | (2006.01) |
| ***B41J 11/00*** | (2006.01) |
| ***B41J 23/02*** | (2006.01) |
| ***B41J 29/38*** | (2006.01) |

(52) U.S. Cl.

CPC ..... *B41J 13/0027* (2013.01); *B41J 2/16532* (2013.01); *B41J 11/0095* (2013.01); *B41J 23/025* (2013.01); *B41J 29/38* (2013.01)

(58) Field of Classification Search

CPC ..... B41J 13/0027
USPC ..... 347/16
See application file for complete search history.

(56) References Cited

U.S. PATENT DOCUMENTS

| | | | | |
|---|---|---|---|---|
| 5,717,443 | A * | 2/1998 | Numata et al. | 347/16 |
| 5,856,835 | A | 1/1999 | Umeda et al. | |
| 7,065,308 | B2 | 6/2006 | Calamita et al. | |

FOREIGN PATENT DOCUMENTS

| | | | |
|---|---|---|---|
| CN | 1623774 | A | 6/2005 |
| CN | 1842478 | A | 10/2006 |
| JP | 2001-129979 | A | 5/2001 |
| KR | 10-0316658 | | 4/2002 |

OTHER PUBLICATIONS

May 4, 2014 Chinese Office Action in Chinese Patent Application No. 201210293631.8.

* cited by examiner

*Primary Examiner* — Manish S Shah
*Assistant Examiner* — Jeffrey C Morgan
(74) *Attorney, Agent, or Firm* — Fitzpatrick, Cella, Harper & Scinto

(57) ABSTRACT

When it is decided that the PE sensor installed upstream of the conveying roller has detected paper, the motor driving the recovery operation is stopped. This prevents paper jamming that may be caused by the reverse rotation of the motor during the recovery operation. That is, when print paper happens to remain on a conveying path for some reason, at a position where it can be driven simultaneously by both of the intermediate and the conveying rollers, the activation of the recovery operation, which is powered by the same motor that drives these rollers, can result in paper jamming because the recovery operation causes the conveying roller to rotate in a direction reverse to that of the intermediate roller. The paper jamming can, however, be prevented by stopping the conveying of the paper before it reaches a position where it is driven by the two rollers at the same time.

5 Claims, 8 Drawing Sheets

INK JET PRINTING APPARATUS AND CONTROL METHOD THEREOF

BACKGROUND OF THE INVENTION

1. Field of the Invention

The present invention relates to an ink jet printing apparatus and a method of controlling the printing apparatus, and more particularly to a control on an ejection performance recovery operation for maintaining an ejection performance of a print head in the printing apparatus and on a paper conveying operation in the printing apparatus.

2. Description of the Related Art

In an ink jet printing apparatus in general, to maintain the ink ejection performance of a print head in good condition, an ejection performance recovery operation is performed which sucks out ink from nozzles of the print head to discharge viscous ink and bubble mixed ink from the print head. As a drive source for this recovery operation, a mechanism has been known to use a motor for driving a conveying roller that conveys a print medium such as a print paper. With the drive source shared by different operations in this way, the number of drive motors can be reduced, allowing the printing apparatus to be reduced in cost and size.

There is a mechanism in which a plurality of rollers for conveying a print paper are used commonly to one driving motor. For example, a conveying roller installed downstream of a paper feeding part in a conveying path is capable of being rotated either in a forward or backward direction according to the direction in which the motor is driven. This allows a paper front end position adjustment to be made to correct an oblique conveying of the paper. On the other hand, an intermediate roller installed upstream of the conveying roller is composed to be rotated only in the forward direction, no matter in which direction the motor is driven. In the above described mechanism that performs the paper conveying using the plurality of rollers and a recovery operation of the print head by a single common motor, there is a case where some of the plurality of rollers may be driven even during the recovery operation. For example, when the motor is reversed in rotation direction to execute the recovery operation, the intermediate roller is rotated in a direction opposite to the direction of the motor drive and also opposite to that of the conveying roller that is driven by the same motor. Normally, this does not pose any serious problem because the recovery operation is not executed while a print medium is conveyed. However, when the recovery operation is executed with a print paper still remaining on the intermediate roller, which may occur as a result of multiple paper conveying, the two rollers rotating in opposite directions to each other convey the print paper and cause a paper jam.

As an approach to this problem, it is described in Japanese Patent Laid-Open No. 2001-129979 that the recovery operation is interrupted immediately after detecting a paper jam during the print head recovery operation. Then the user manually removes the paper for which the paper jam error has been annunciated and that, when the presence of paper is no longer detected by a paper jam sensor, the printing apparatus enters into a standby state for printing.

With the above described method of Japanese Patent Laid-Open No. 2001-129979, however, the paper jam that is caused by the reverse rotation of the roller during the recovery operation cannot be prevented. As a result of this, the paper jam error, when it occurs, needs to be cleared by manually removing the paper and therefore the printing apparatus is deemed not user-friendly.

SUMMARY OF THE INVENTION

An object of the present invention is to provide an ink jet printing apparatus and a method of controlling the printing apparatus, which can prevent a paper jam that could be caused by the reverse rotation of the roller accompanied by the recovery operation that shares the same drive source with the print medium conveying operation.

In a first aspect of the present invention, there is provided an ink jet printing apparatus that performs printing by ejecting ink from a print head, the apparatus comprising:

a first conveying unit configured to have a roller and to convey print medium by rotating the roller;

a second conveying unit configured to have a roller installed downstream of the roller of the first conveying unit on a conveying path, and to convey the print medium by rotating the roller;

a recovery unit configured to perform a recovery operation for maintaining an ink ejection performance of the print head;

a motor for commonly producing a drive force for the rotation of the roller of the first conveying unit and the roller of the second conveying unit and for the recovery operation of the recovery unit;

a drive force transmission unit configured to transmit the drive force of the motor so as to rotate the roller of the first conveying unit in a forward direction and rotate the roller of the second conveying unit in the forward direction by driving by the motor in a first direction, and rotate the roller of the first conveying unit in the forward direction, rotate the roller of the second conveying unit in a direction reverse to the forward direction, and perform the recovery operation of the recovery unit by driving by the motor in a second direction reverse to the first direction;

a detection unit configured to be installed upstream of the roller of the second conveying unit on the conveying path to detect the print medium being conveyed; and a control unit configured to stop driving by the motor when the detection unit detects the print medium while the recovery unit is performing the recovery operation by drive force transmitting by the drive force transmission unit.

In a second aspect of the present invention, there is provided a method of controlling an ink jet printing apparatus that performs printing by ejecting ink from a print head, the method comprising:

a first conveying step of using a roller and conveying print medium by rotating the roller;

a second conveying step of using a roller installed downstream of the roller of the first conveying step on a conveying path, and conveying the print medium by rotating the roller;

a recovery step of performing a recovery operation for maintaining an ink ejection performance of the print head;

a step of providing a motor for commonly producing a drive force for the rotation of the roller of the first conveying step and the roller of the second conveying step and for the recovery operation of the recovery step;

a step of providing a drive force transmission unit configured to transmit the drive force of the motor so as to rotate the roller of the first conveying step in a forward direction and rotate the roller of the second conveying step in the forward direction by driving by the motor in a first direction, and rotate the roller of the first conveying step in the forward direction, rotate the roller of the second conveying step in a direction reverse to the forward direction, and perform the recovery operation of the recovery step by driving by the motor in a second direction reverse to the first direction;

a detecting step of using a detection unit configured to be installed upstream of the roller of the second conveying step on the conveying path to detect the print medium being conveyed; and a control step of stopping driving by the motor when the detecting step detects the print medium while the recovery step is performing the recovery operation by drive force transmitting by the drive force transmission unit.

According to the above configuration, it is possible to prevent a paper jam that could result from the reverse rotation of the roller accompanied by the recovery operation, the recovery operation using the same drive source that powers the print medium conveying operation.

Further features of the present invention will become apparent from the following description of exemplary embodiments (with reference to the attached drawings).

DESCRIPTION OF THE EMBODIMENTS

Embodiments of the present invention will be described in detail by referring to the accompanying drawings.

Figure 1:
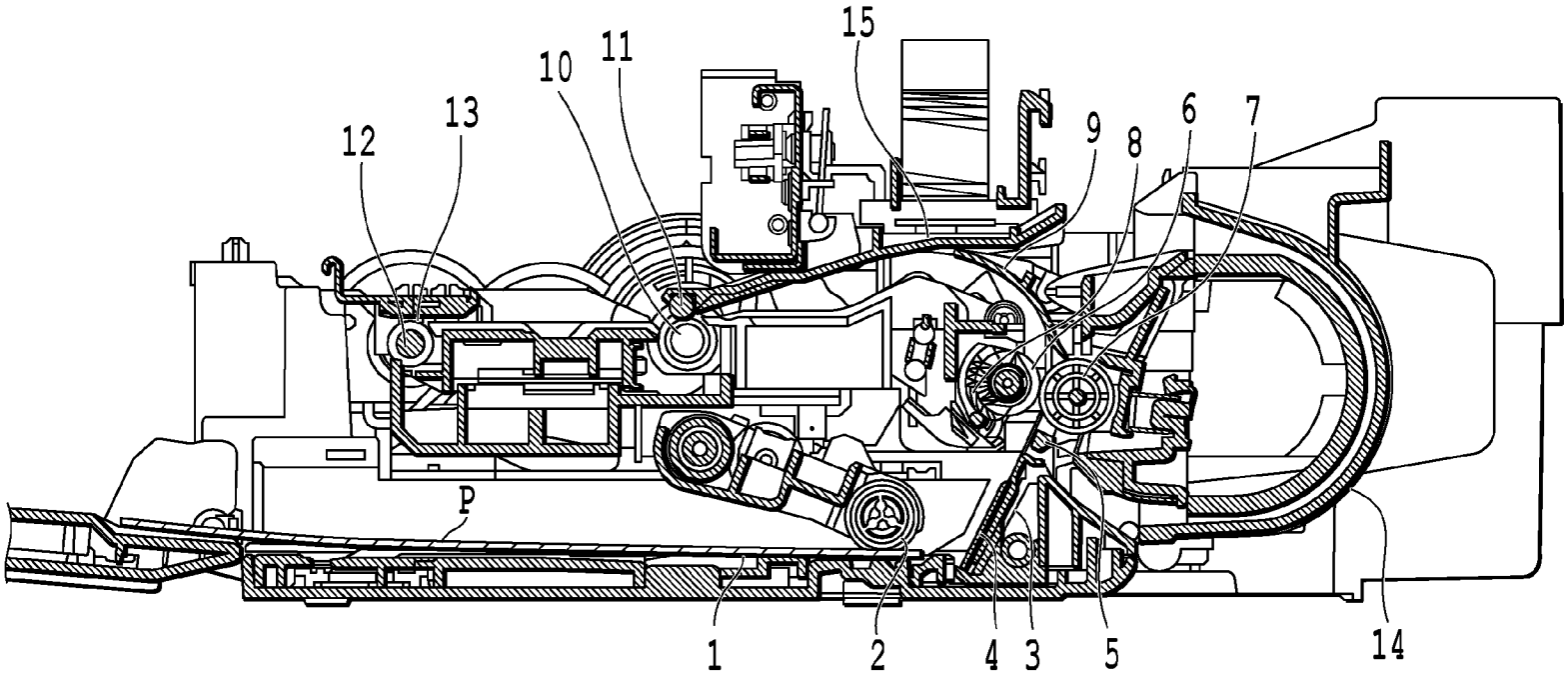
FIG. 1 is a longitudinal cross-sectional view of an entire printing apparatus according to one embodiment of this invention.

FIG. 1 is a longitudinal cross-sectional view showing an ink jet printing apparatus(a printer) as one embodiment of the present invention. In FIG. 1, when a print command is issued from a host device such as PC to a printer control; unit, the printer control unit drives a motor 21 (see FIG. 2; thus is not shown in FIG. 1). This motor drives a paper feed mechanism 2, an intermediate roller 6, conveying roller 10 arranged downstream of the intermediate roller 6, and a paper discharge roller 12 arranged downstream of the conveying roller. More specifically, the paper feed mechanism 2 pushes one of the papers P stacked on a paper tray 1 against a separation member 4 to separate one paper from the stacked papers. The separated paper P is conveyed by the paper feed mechanism 2 to the intermediate roller 6 (which is paired with a pinch roller 7 to constitute a first conveying unit). After passing through the intermediate roller 6, the front end of the paper P comes into contact with the outer circumference of a U-shaped paper guide and is reversed in a conveying direction as it moves along the paper guide before it arrives at the conveying roller 10 (which is paired with a pinch roller 11 to form a second conveying unit). When the front end of the paper P reaches a nip portion of the conveying roller 10, the printer adjusts the front end position of the paper P according to the kind of paper (hereinafter referred to also as a front end registration) to correct an oblique conveyance of the paper P. To perform the front end registration, the conveying roller 10 can also be rotated by the driving force of the motor 21 in a direction that moves the paper P back. On the other hand, the intermediate roller 6 is arranged so that the intermediate roller 6 always rotates in a discharge direction of the paper P, no matter in which direction the motor 21 is driven. In this arrangement of the intermediate roller 6 and the conveying roller 10, when the paper P reaches the conveying roller 10, the motor 21 reverses its direction of rotation. This allows the conveying roller 10 to rotate in a direction that temporarily moves the paper P back so that the paper P is formed into a loop in a front of the conveying roller 10. Then, the conveying roller 10 is rotated in a direction in which the paper P is discharged, thus completing the front end registration. With the front end registration complete, the paper P is conveyed onto a platen. Above the platen is arranged a printing unit (not shown) that scans in a direction perpendicular to a conveying direction of the paper P, thus forming an image on the paper P, and to the paper P conveyed onto the platen ink is ejected from a print head of the printing unit and an image is printed. The paper conveyance by the conveying roller 10 and the printing unit are alternately repeated until a complete image is formed on the paper P, after which the paper discharge roller 12 (which is paired with a spur 13 to form a third conveying unit) moves the paper P in a discharge direction.

Figure 2:
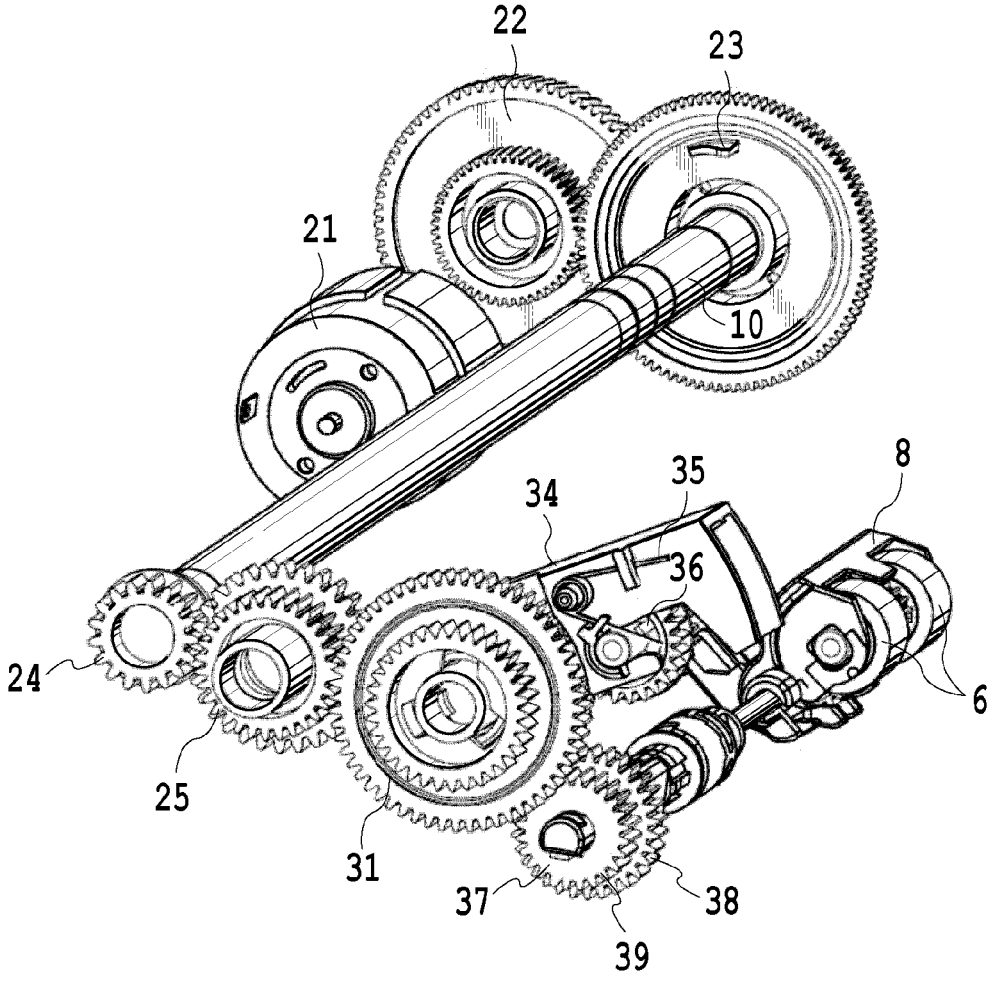
FIG. 2 is a perspective view of a drive mechanism for the printing apparatus of FIG. 1.

FIG. 2 is a perspective view showing a drive mechanism in the printing apparatus of FIG. 1, and shows details of a drive force transmission mechanism that transmits a driving force of a motor to the conveying roller 10 and the intermediate roller 6. In this embodiment, the conveying roller and the intermediate roller are driven commonly by a motor 21, which in turn allows for reduction in size and cost of the printing apparatus. A gear (not shown) fitted on a rotating shaft of the motor is connected through an idler gear 22 to a conveyance input gear 23 mounted on a shaft of the conveying roller 10. The conveyance input gear 23 is fitted with a code wheel (not shown) that has markings thereon for detection of the amount of rotation of the motor. An encode sensor (not shown) reads the markings on the code wheel to enable the amount of rotation of the conveying roller 10 to be controlled. On the other end of the shaft of the conveying roller 10 is mounted a conveyance output gear 24, which transmits its driving force through an idler gear 25 to a sun gear 31. The sun gear 31 is formed as a clutch gear.

Figure 3:
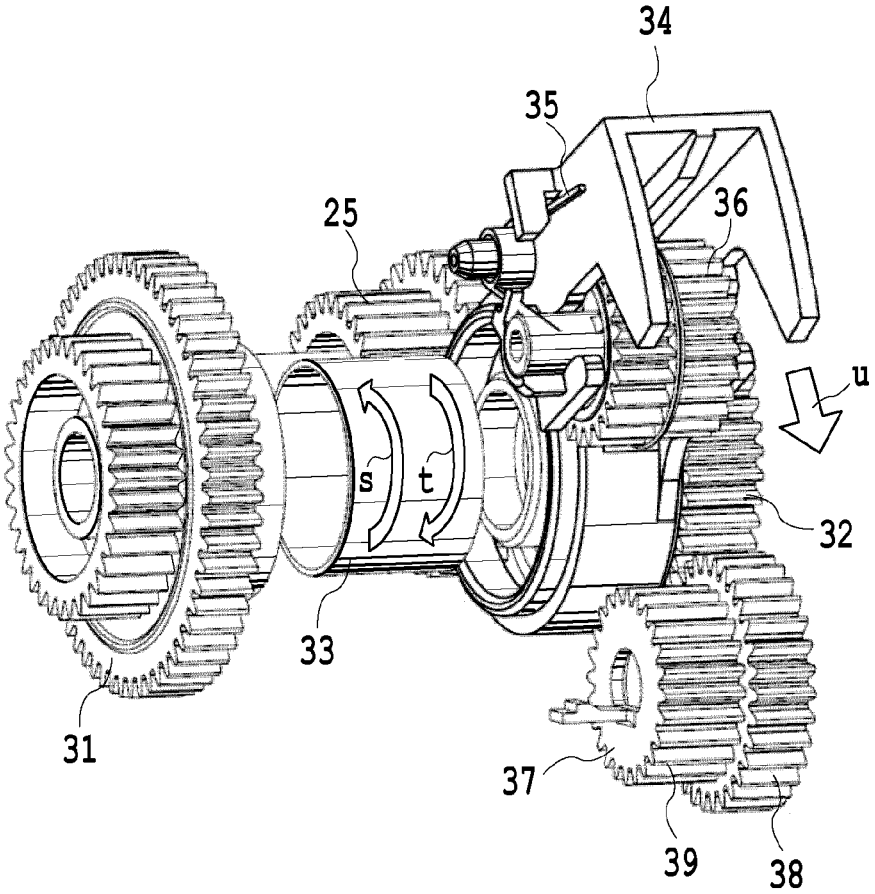
FIG. 3 is a perspective view of a clutch gear shown in FIG. 2.

FIG. 3 is a perspective view showing a detailed structure of the clutch gear shown in FIG. 2. As shown in FIG. 3, there is a spring 33 inside the sun gear 31, which, when the sun gear 31 rotates in a forward direction, tightens up causing the sun gear 31 and the sun gear 32 to rotate together. When on the other hand the sun gear 31 rotates in a backward direction, the spring 33 loosens up to decouple the sun gear 31 and the sun gear 32, allowing them, when the sun gear 32 is loaded, to slip and rotate relative to each other. On the shaft of the sun gear 31 is provided a swing arm 34 on which a planet gear 36 is fitted. Between the planet gear 36 and the swing arm 34 is installed a swing arm spring 35 which moves the swing arm 34 together with the sun gear 31 as the latter rotates. The sun gear 32 is connected with a cog stage 38 of a multi-stage gear 37. The multi-stage gear 37 has another cog stage 39 at a position where it can be brought into connection with the planet gear 36. In the above configuration, when the sun gear 31 rotates in the forward direction (in a direction of arrow s), the driving force received by it is transmitted to the cog stage 38 of the multi-stage gear 37 through the sun gear 32 that is coupled with and rotates with the sun gear 31. When the sun gear 31 rotates in the backward direction (arrow t), the swing arm 34 moves in a direction shown by arrow u to bring the planet gear 36 into connection with the cog stage 39 of the multi-stage gear 37, and thus the driving force of the sun gear 31 is transmitted to the multi-stage gear 37. It is noted that since the sun gear 32 is formed as the clutch gear, when the sun gear 31 rotates in the backward direction, the sun gear 32 easily slips and does not obstruct the sun gear 31 transmitting its drive force. With this method of the drive force transmission, the multi-stage gear 37 can be made to rotate always in the same direction whether the sun gear 31 is rotating in the forward direction or the backward direction.

Figure 4:
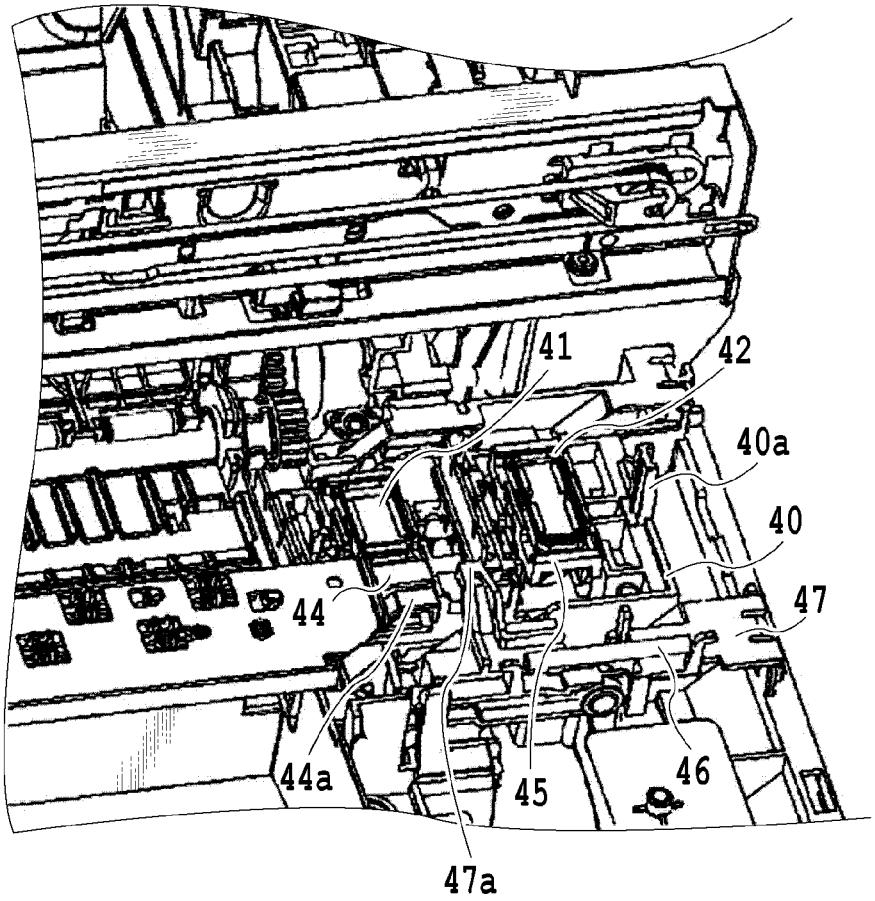
FIG. 4 is a perspective view of a cleaning mechanism in the printing apparatus of FIG. 1.

FIG. 4 is a perspective view showing a recovery mechanism that maintains the ink ejection performance of the print head in the printing apparatus of FIG. 1. In FIG. 4, a slider 40 is slidable outside a print area in accordance with a reciprocal movement of the print head. It can also be moved in a direction (ink ejection direction) perpendicular to each of color and black ink ejection faces of the print heads. The movements of the slider 40 in the perpendicular directions brings the caps 41, 42 into close (hermetic) contact with, and causes them to depart from, the nozzle faces of the print heads. The slider 40 has cap holders 44, 45 mounted thereon which, according to the movement of the print head, can be moved in an area different from the print area in a direction of a carriage movement and also in a direction in which the caps are moved toward or away from the associated black and color print heads. The caps 41, 42 are connected with pump tubes 51*a*, 51*b* that are in turn connected to a suction pump (pump mechanism) that generates a negative pressure. With the above structure, the recovery operation to draw out ink by suction from the ink ejection faces of the print heads through the caps can be performed.

Figure 5:
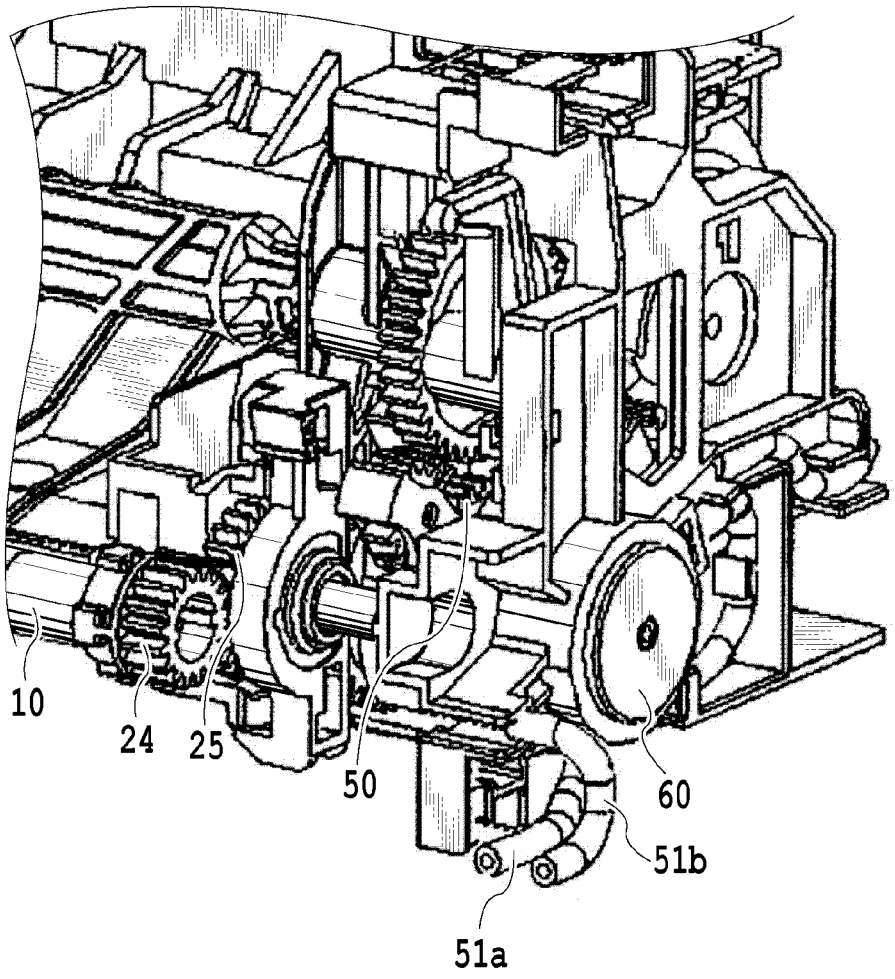
FIG. 5 is a perspective view showing a drive force transmission mechanism from conveying rollers to a pump mechanism in the printing apparatus of FIG. 1.
Figure 6:
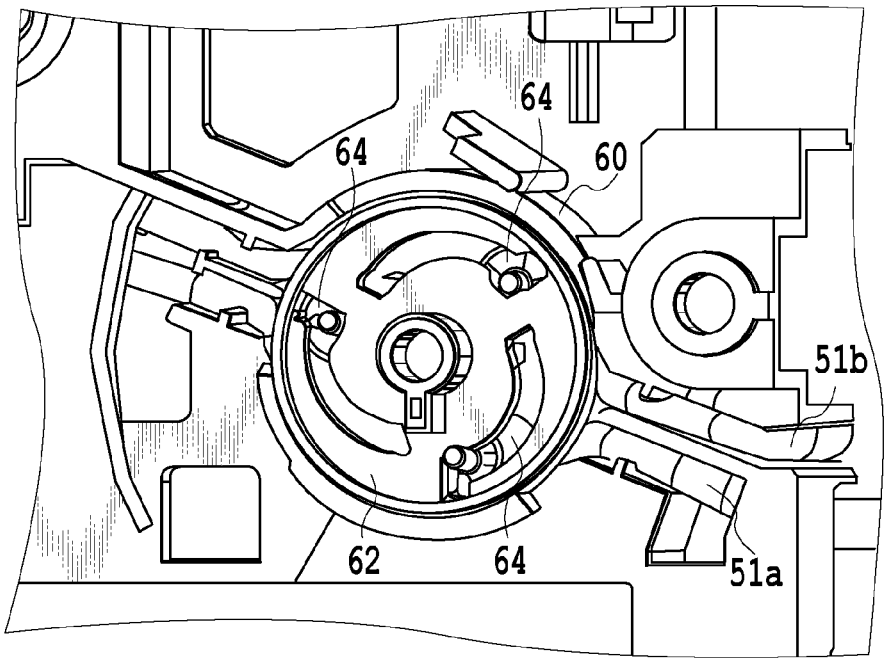
FIG. 6 is a perspective view of the pump mechanism shown in FIG. 5.

FIG. 5 is a perspective view of a drive force transmission mechanism ranging from the conveying roller to the pump mechanism in the printing apparatus of FIG. 1. FIG. 6 is a perspective view of the pump mechanism shown in FIG. 5. As shown in these figures, a pump roller holder 62 is provided with cam grooves, in which parts of pump rollers 64 engage. The pump tubes 51*a*, 51*b* are installed so that they extend half circle along an inner wall of the pump base 60. The pump roller holder 62 is installed so that the roller holder rotates inside the pump base 60 attached with the pump tubes. When, with the print heads capped with the caps 41, 42, the conveying roller 10 is reversed by the shared motor 21, the drive force is transmitted through the conveyance output gear 24, idler gear 25 and pump drive gear 50 to the pump roller holder 62. Upon receiving the drive force, the pump roller holder 62 causes the pump rollers 64 to be engaged in its cam grooves to move, pressing the pump tubes 51*a*, 51*b* flat between them and the inner wall of the pump base 60. As the conveying roller 10 continues to be driven in the backward direction, a negative pressure is generated in the pump tubes. With the ink ejection faces of the color and black ink print heads hermetically covered with the caps 41, 42, the negative pressure thus produced sucks out ink from the ink nozzles of the print heads through the caps 41. 42. To eliminate the negative pressure in the pump tubes after the ink suction operation has been finished, the pump roller holder 62 is reversed (the conveying roller is rotated in the forward direction). This causes the pump roller 64 to part from the pump tubes 51*a*, 51*b*, eliminating the negative pressure in the pump tubes. As described above, the motor 21 used for both the conveying roller 10 and the intermediate roller 6 drives the tube pump and the motor is operated to rotate the conveying roller 10 backwardly to produce a negative pressure in the pump tubes.

Figure 7:
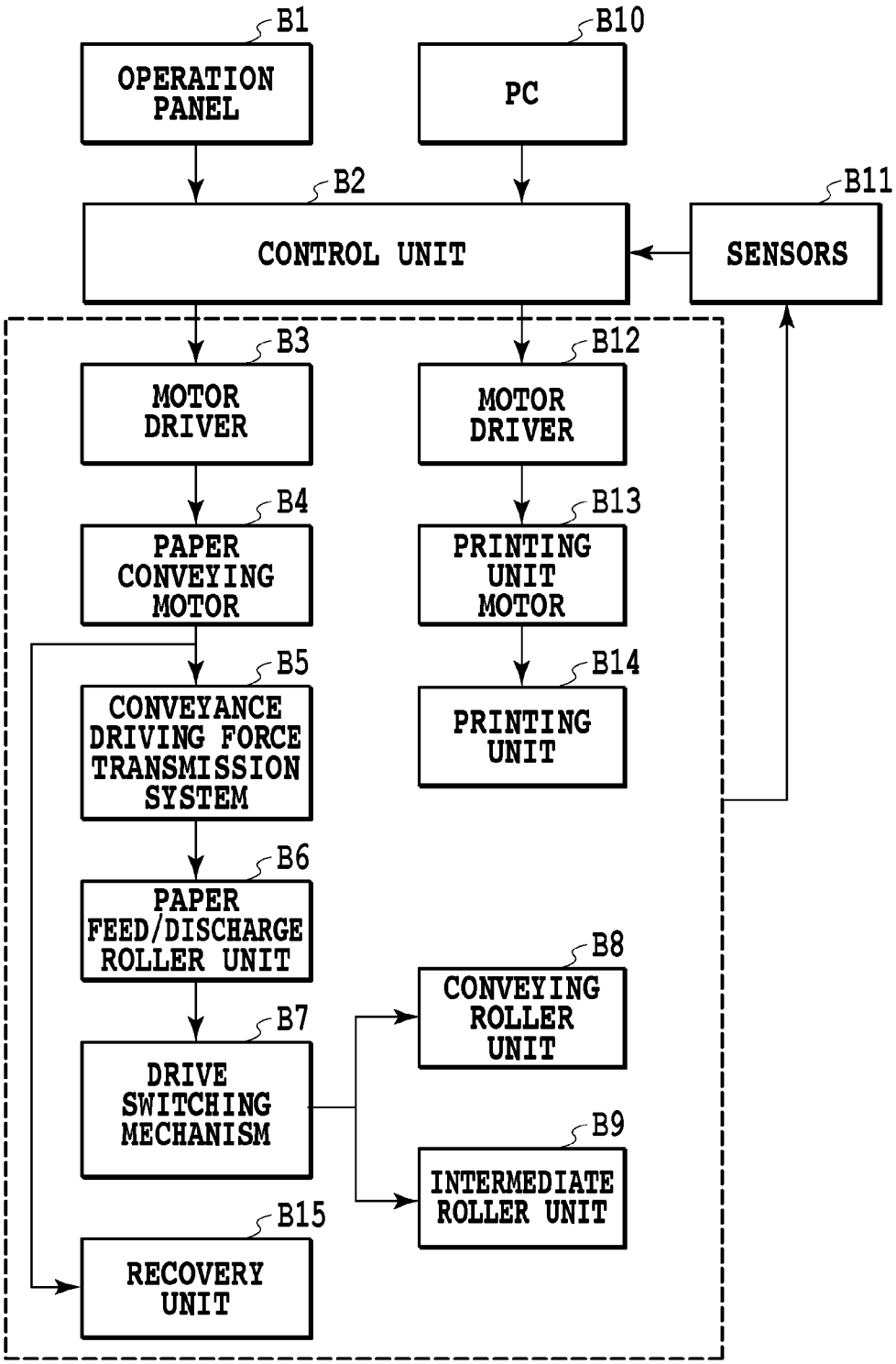
FIG. 7 is a block diagram showing an outline configuration of control on the printing apparatus of FIG. 1.

FIG. 7 is a block diagram showing an outline of the control configuration of the printing apparatus shown in FIG. 1. As shown in FIG. 7, a control unit B2, in response to an input from an operation panel B1 or a PC B10 connected thereto, outputs a motor current control signal to motor drivers B3, B12 to perform the following control. More specifically, a paper conveying motor B4, which corresponds to the motor 21 used for driving the aforementioned conveying roller and the like, drives a paper feed/discharge roller unit B6 through a conveying driving force transmission system B5 and a drive switching mechanism B7 according to a signal it received from the motor driver B3. The paper conveying motor also drives a conveying roller unit B8 and an intermediate roller unit B9, which correspond to the conveying roller and the intermediate roller, respectively. Further, the paper conveying motor B4 also drives the pump tubes of the recovery unit described with reference to FIG. 6.

A printing unit motor B13 in response to a signal from the motor driver B12 drives a printing unit B14. Sensors B11 installed in the paper conveying unit and the printing unit detect a paper position, the number of rotations of the conveying roller, a print position of the printing unit and others and sends these detected signals to the control unit 2, which in turn outputs appropriate control signals to the motor drivers B3, B12 again.

Figure 8:
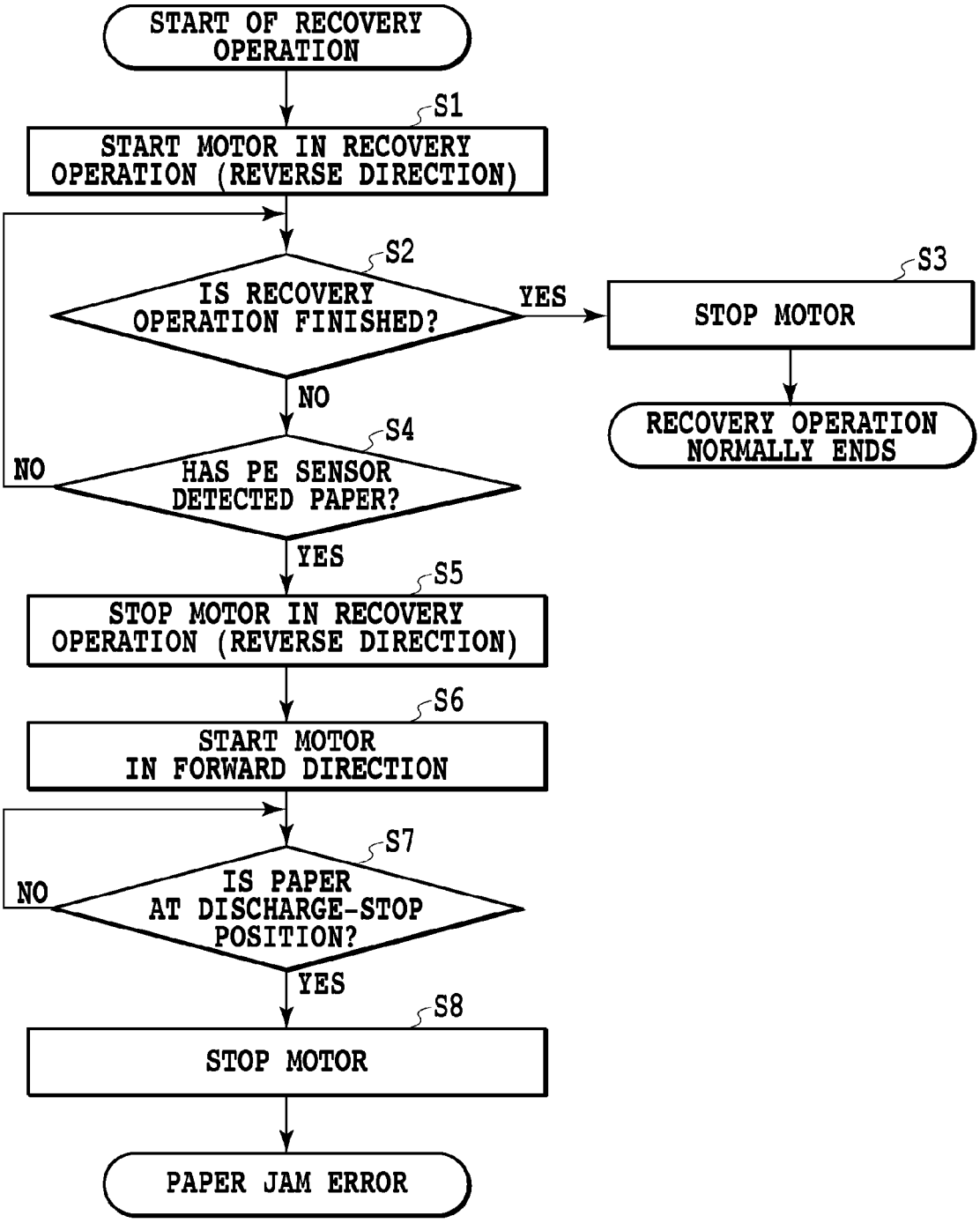
FIG. 8 is a flow chart showing a printing apparatus control as one embodiment of this invention.

FIG. 8 is a flow chart of a printing apparatus control sequence as one embodiment of the present invention, showing in particular a print medium conveying control executed during the ink ejection performance recovery operation.

In the printing apparatus described so far as one embodiment of the present invention, when the print head recovery operation is executed, the intermediate roller 6 and the conveying roller 10 are also driven because these rollers use, as their drive source, the same motor 21 that drives the recovery operation. Since during the recovery operation the motor 21 rotates in a reverse direction (second direction), the conveying roller 10 and paper discharge roller 12 are rotated in the reverse direction, the same rotating direction of the motor 21, that moves the paper backward. Since the intermediate roller 6 always rotates forwardly, i.e., in a direction that the paper is discharged, the conveying roller 10 and the intermediate roller 6 rotate in opposite directions.

To cope with this condition, this embodiment performs the following control. As shown in FIG. 8, the motor 21 is rotated in a reverse direction to start the recovery operation (S1). Then a check is made as to whether the recovery operation is finished (S2). If the recovery operation is determined to have finished, the motor 21 is stopped (S3) to end this processing. If, on the other hand, the recovery operation is not finished (S2), a check is made to see if a PE sensor installed upstream of the conveying roller to detect paper ends has detected the front end of the paper (S4). If, during the recovery operation, it is determined that the PE sensor installed upstream of the conveying roller 10 on the paper conveying path has detected the paper end, the motor 21 for the recovery operation is stopped (S5). This prevents a paper jam that would otherwise be caused by the motor 21 rotating in the reverse direction for the recovery operation. That is, in executing the recovery operation, a control is normally performed to prevent the drive force from being transmitted from the motor 21 to the paper feed mechanism 2 to ensure that the print paper will not enter onto the conveying path. There may be a case, however, where a print paper happens to be left on the conveying path for some reason, as by multiple paper feeding, at a position where it can be driven by both of the intermediate roller 6 and the conveying roller 10. In that case, the activation of the recovery operation, which uses the same motor that drives these rollers, causes the intermediate roller 6 and the conveying roller 10 to rotate in opposite directions and can therefore result in paper jamming. To deal with this problem, the conveying of the paper P is stopped before the paper arrives at a position where it is driven by the two rollers rotating in different directions. With this control, the paper jamming can be prevented.

After the reverse rotation of the motor 21 for the recovery operation is stopped, the motor 21 is driven in the forward direction (first direction) (S6) to rotate the conveying roller 10, the discharge roller 12 and the intermediate roller 6 in the same direction to discharge the paper P. At the same time a paper jam error is annunciated to inform the user that the recovery operation has been interrupted and that an unintended paper discharging has been done. In this paper discharge operation, the paper P, before being fully discharged, is stopped with its rear end held between the discharge roller 12 and its associated spur (S7). The reason for stopping the paper P on the discharge roller is that, if the paper is discharged completely, the user will end up taking an unnecessary action to clear the annunciated paper jam error despite there being no paper in the printer that has caused the paper jam error.

With the embodiment described above, a possible paper jamming that would result from the reverse rotation of the roller executed for the print head recovery operation can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179777, filed Aug. 19, 2011, which is hereby incorporated by reference herein in its entirety.

What is claimed is:

1. An ink jet printing apparatus that performs printing by ejecting ink from a print head, said apparatus comprising:

a first conveying roller configured to convey a print medium;

a second conveying roller located downstream of the first conveying roller in a conveying direction of the print medium and configured to convey the print medium;

a recovery unit configured to perform a recovery operation of the print head;

a motor rotatable in first and second directions and configured to produce a drive force for the first conveying roller, the second conveying roller, and the recovery unit;

a drive force transmission unit configured to transmit the drive force of the motor so as to rotate the first conveying roller in a forward direction and rotate the second conveying roller in the forward direction when the motor rotates in the first direction, and rotate the first conveying roller in the forward direction, rotate the second conveying roller in a reverse direction, and perform the recovery operation when the motor rotates in the second direction;

a detection unit located between the first conveying roller and the second conveying roller in the conveying direction and configured to detect a leading edge of the print medium; and a control unit configured to stop the motor if the detection unit detects a leading edge of the print medium while the recovery unit is performing the recovery operation when the motor rotates in the second direction.

2. An ink jet printing apparatus according to claim 1, wherein the drive force transmission unit has a transmission mechanism, in which a gear attached on a rotating shaft of the motor is coupled to an input gear attached on a shaft of the second conveying roller, in which an output gear attached on the shaft of the second conveying roller is coupled to a first sun gear, in which the first sun gear is coupled to a second sun gear through a spring that constitutes a clutch, in which a swing arm to which a planet gear is attached and which rotates together with the first sun gear is attached on a shaft of the first sun gear, in which a first cog stage of a multi-stage gear is coupled to the second sun gear, in which a second cog stage of the multi-stage gear can be coupled to the planet gear, and in which the multi-stage gear is attached on a shaft of the first conveying roller.

3. An ink jet printing apparatus according to claim 1, wherein the control unit, after stopping the motor, controls the motor to rotate in the first direction to rotate the the second conveying roller in the forward direction and thereby convey the print medium in a discharge direction.

4. An ink jet printing apparatus according to claim 3, further comprising a third conveying roller located downstream of the second conveying roller in the conveying direction of the print medium, and configured to convey the print medium;

wherein the control unit controls the rotation of the second conveying roller in the forward direction to convey the print medium in the discharge direction and to stop and hold the print medium on the third conveying roller.

5. A method of controlling an ink jet printing apparatus that performs printing by ejecting ink from a print head, said method comprising:

a first conveying step of using a first conveying roller to convey a print medium;

a second conveying step of using a second conveying roller located downstream of the first conveying roller in a conveying direction of the print medium to convey the print medium;

a recovery step of performing a recovery operation of the print head;

a step of providing a motor rotatable in first and second directions to produce a drive force for the first conveying step, the second conveying step, and the recovery step;

a step of providing a drive force transmission unit configured to transmit the drive force of the motor so as to rotate the first conveying roller in a forward direction and rotate the second conveying roller in the forward direction when the motor rotates in the first direction, and rotate the first conveying roller in the forward direction, rotate the second conveying roller in a reverse direction, and perform the recovery operation when the motor rotates in the second direction;

a detecting step of using a detection unit located between the first conveying roller and the second conveying roller in the conveying direction and configured to detect a leading edge of the print medium; and a control step of stopping the motor if the detecting step detects a leading edge of the print medium while the recovery step is performing the recovery operation when the motor rotates in the second direction.

* * * * *